US008469767B2

(12) United States Patent
Rehkemper et al.

(10) Patent No.: US 8,469,767 B2
(45) Date of Patent: Jun. 25, 2013

(54) VEHICLE WITH CONTROLLED MOTORIZED MOVEMENTS

(75) Inventors: Steven Rehkemper, Chicago, IL (US); Ryan Kratz, Oak Park, IL (US); Phillip Fensil, Chicago, IL (US)

(73) Assignee: Rehco LLC, Chicago, IL (US)

( * ) Notice: Subject to any disclaimer, the term of this patent is extended or adjusted under 35 U.S.C. 154(b) by 410 days.

(21) Appl. No.: 12/862,337

(22) Filed: Aug. 24, 2010

(65) Prior Publication Data

US 2011/0053457 A1 Mar. 3, 2011

Related U.S. Application Data

(60) Provisional application No. 61/236,365, filed on Aug. 24, 2009.

(51) Int. Cl.
*A63H 18/00* (2006.01)

(52) U.S. Cl.
USPC ..... 446/466; 446/427; 446/465

(58) Field of Classification Search
USPC ..... 446/427, 465, 466
See application file for complete search history.

(56) References Cited

U.S. PATENT DOCUMENTS

| | | | | |
|---|---|---|---|---|
| 4,390,187 | A * | 6/1983 | Maeda | 280/6.159 |
| 5,322,469 | A * | 6/1994 | Tilbor | 446/454 |
| 5,334,077 | A * | 8/1994 | Bailey | 446/466 |
| 5,527,059 | A * | 6/1996 | Lee, Jr. | 446/466 |
| 5,643,041 | A * | 7/1997 | Mukaida | 446/455 |
| 5,785,576 | A * | 7/1998 | Belton | 446/456 |
| 6,383,054 | B1 * | 5/2002 | Rauch | 446/456 |
| 6,793,555 | B1 * | 9/2004 | Tilbor et al. | 446/456 |
| 8,079,892 | B2 * | 12/2011 | Wang et al. | 446/466 |

* cited by examiner

*Primary Examiner* — Gene Kim
*Assistant Examiner* — Joseph B Baldori

(57) ABSTRACT

A toy vehicle is provided with front and rear wheelbase mechanisms. Both are movably secured to a chassis, but the front mechanism moves two front segments positioned within two channels on the chassis and the rear mechanism moves a rear segment with a rear axle pivotally secured to a lower portion of the rear segment. The segments include rotatable wheels. There is also provided a motor and a clutch. The clutch is in communication with the front and rear wheelbase mechanisms. The motor when moved in a first direction engages the clutch to direct the front wheelbase mechanism to raise and lower the front segments. The motor when moved in a second direction engages the clutch to direct the rear wheelbase mechanism to raise and lower the rear segment and rear axle.

4 Claims, 9 Drawing Sheets

10

VEHICLE WITH CONTROLLED MOTORIZED MOVEMENTS

CROSS REFERENCE TO RELATED APPLICATIONS

The present application claims priority to U.S. Provisional Application 61/236,365 filed on Aug. 24, 2009.

FIELD OF THE INVENTION

The present invention relates to a vehicle with controlled motorized movements.

BACKGROUND OF THE INVENTION

Conventional vehicles which include the ability to transform from one or more positions are typically manual manipulated vehicles that require various skills and knowledge of the final positions. A need exists for a toy vehicle that includes motorized movements that control and move the vehicle into the various transformation positions.

BRIEF DESCRIPTION OF THE DRAWINGS

A fuller understanding of the foregoing may be had by reference to the accompanying drawings, wherein.

SUMMARY OF THE INVENTION

Figure 1:
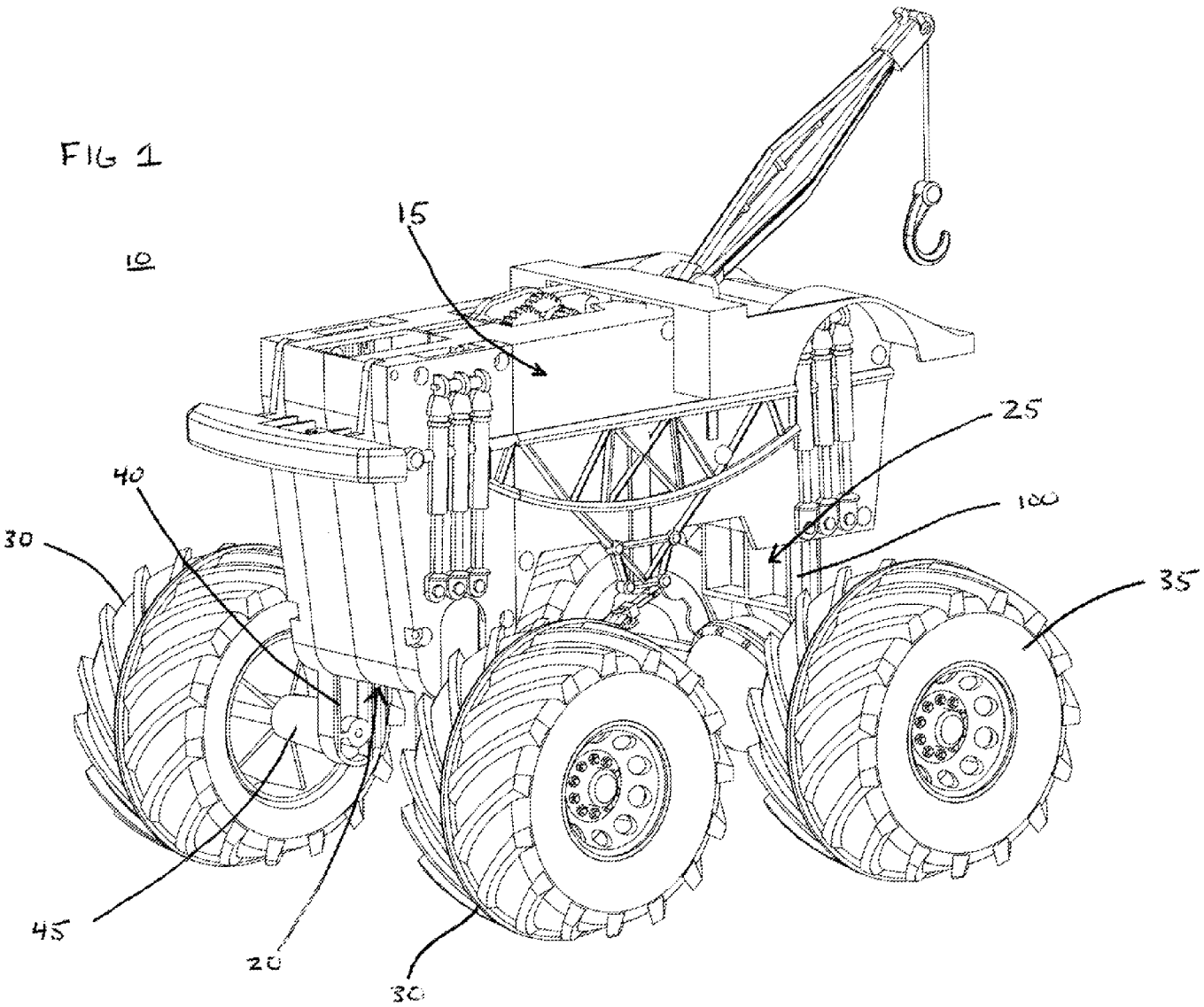
FIG. 1 is a front perspective view of a vehicle in accordance with an embodiment of the present invention.

In one or more of the embodiments of the present invention there is provided a toy vehicle having a chassis with a front wheelbase mechanism moveably secured to the chassis to raise and lower a set of front wheels. The front wheelbase mechanism further includes two front segments. Each front segment has one of the front wheels rotatably attached to a lower end of each segment. The front segments further positioned within two channels in the chassis for guiding movement of the front segments. Two front springs are secured at an upper end of each front segment and to the chassis. The springs are biased toward the lower end of each segment. Each front segment further includes a toothed edge meshed to a front gear train in communication with a motor and includes a clutch, such that when the motor is powered in a first direction, the clutch engages the front gear train to direct upward and downward movement of the front segments. In addition to the front wheelbase, a rear wheelbase mechanism is moveably secured to the chassis to raise and lower a set of rear wheels that are pivotally secured to the rear wheelbase mechanism. The rear wheelbase mechanism includes a rear segment with a lower portion pivotally attached to a rear axle and includes the set of rear wheels rotatably attached thereto. The rear segment further has a rear toothed edge meshed to a transfer gear. A lower portion of a rear spring is secured to the chassis and an upper portion of the rear spring is secured to the rear segment and biased toward the rear axle. The transfer gear is meshed to a rear gear train in communication with the clutch, such that when the motor is powered in a second direction, the clutch engages and transfers movement to the rear segment and rear axle, such that the rear segment raises and lowers the rear axle. Therefore powering the motor in the first and second directions animates the vehicle as the front segments and rear segment raise and lower.

In other aspects of this embodiment the vehicle further includes an integrated circuit for receiving signals generated in response to a triggering means and for controlling activation of the motor to direct movement of the front wheels and rear wheels in response to the signals.

Other aspects may include providing the front gear train with two triangular gears meshed to the toothed portion of the front segments. The triangular gears being less than 360 degrees of teeth, such that the triangular gears direct the front segments downward while the teeth are meshed, and then the front springs pull the front segment upward when the teeth are not meshed. This aspect may further provide the toothed portions of the triangular gears offset relative to one another such that the front segments alternately raise and lower as the motor powers in the first direction. Yet other aspects may further include providing the transfer gear with less than 360 degrees of teeth, such that the transfer gear directs the rear segment downward while the teeth are meshed, and then the rear spring pulls the rear segment upward when the teeth are not meshed.

In addition thereto, the embodiment of the vehicle further includes a circuit board in communication with the triggering means and a receiver and a remote control unit with a transmitter to send commands to the receiver, such that the circuit board can send control signals to the triggering means to activate and power the motor in a first and/or second direction.

In a second embodiment of the invention there may be provided an animated toy vehicle comprising front and rear wheelbase mechanisms. The front wheelbase mechanism is movably secured to a chassis and includes a means to direct movement of two front segments positioned within two channels on the chassis and includes a wheel rotatably attached at the lower end of each front segment. The rear wheelbase mechanism is movably secured to the chassis and includes a means to direct movement of a rear segment with a rear axle pivotally secured to a lower portion of the rear segment and includes two wheels rotatably attached thereto. In addition thereto, there is provided a motor, a front gear train, a rear gear train, and a clutch in mechanical communication with the front wheelbase mechanism and rear wheelbase mechanism. The motor is able to move in a first direction to engage the clutch to direct the front wheelbase mechanism and means to direct movement of the front segments to raise and lower the front segments. The motor is also able to move in a second direction to engage the clutch to direct the rear wheelbase mechanism and means to direct movement of a rear segment to raise and lower the rear segment and rear axle.

The means to direct movement of the front segments can include two front springs secured at an upper end of each front segment and to the chassis, where the springs further are biased toward the lower end of each segment; and each front segment further includes a toothed edge meshed to the front gear train in communication with a motor and including a clutch, such that when the motor is powered in a first direction, the clutch engages the front gear train to direct upward and downward movement of the front segments.

The means to direct movement of the rear segment can include a rear segment with a lower portion pivotally attached to a rear axle including two wheels rotatably attached thereto. The rear segment further includes a rear toothed edge meshed to a transfer gear. A lower portion of a rear spring is secured to the chassis and an upper portion of the rear spring is secured to the rear segment and biased toward the rear axle. The transfer gear is meshed to the rear gear train in communication with the clutch, such that when the motor is powered in a second direction, the clutch engages and transfers movement to the rear segment and rear axle, such that the rear segment raises and lowers the rear axle.

The second embodiment may also include an integrated circuit for receiving signals generated in response to a triggering means and for controlling activation of the motor to direct movement of the front wheels and rear wheels in response to the signals. In addition, the front gear train may include two triangular gears meshed to the toothed portion of the front segments. The triangular gears have less than 360 degrees of teeth, such that the triangular gears direct the front segments downward while the teeth are meshed, and then the spring pulls the front segment upward when the teeth are not meshed. The toothed portions of the triangular gears may also be offset relative to one another such that the front segments alternately raise and lower as the motor powers in a first direction.

Furthermore, the rear gear train may also include a transfer gear having less than 360 degrees of teeth. The transfer gear can then direct the rear segment downward while the teeth are meshed, then the rear spring pulls the rear segment upward when the teeth are not meshed.

Numerous other advantages and features of the invention will become readily apparent from the following detailed description of the invention and the embodiments thereof, from the claims, and from the accompanying drawings.

DETAILED DESCRIPTION OF THE EMBODIMENTS

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention, claims or the embodiments illustrated.

Figure 2:
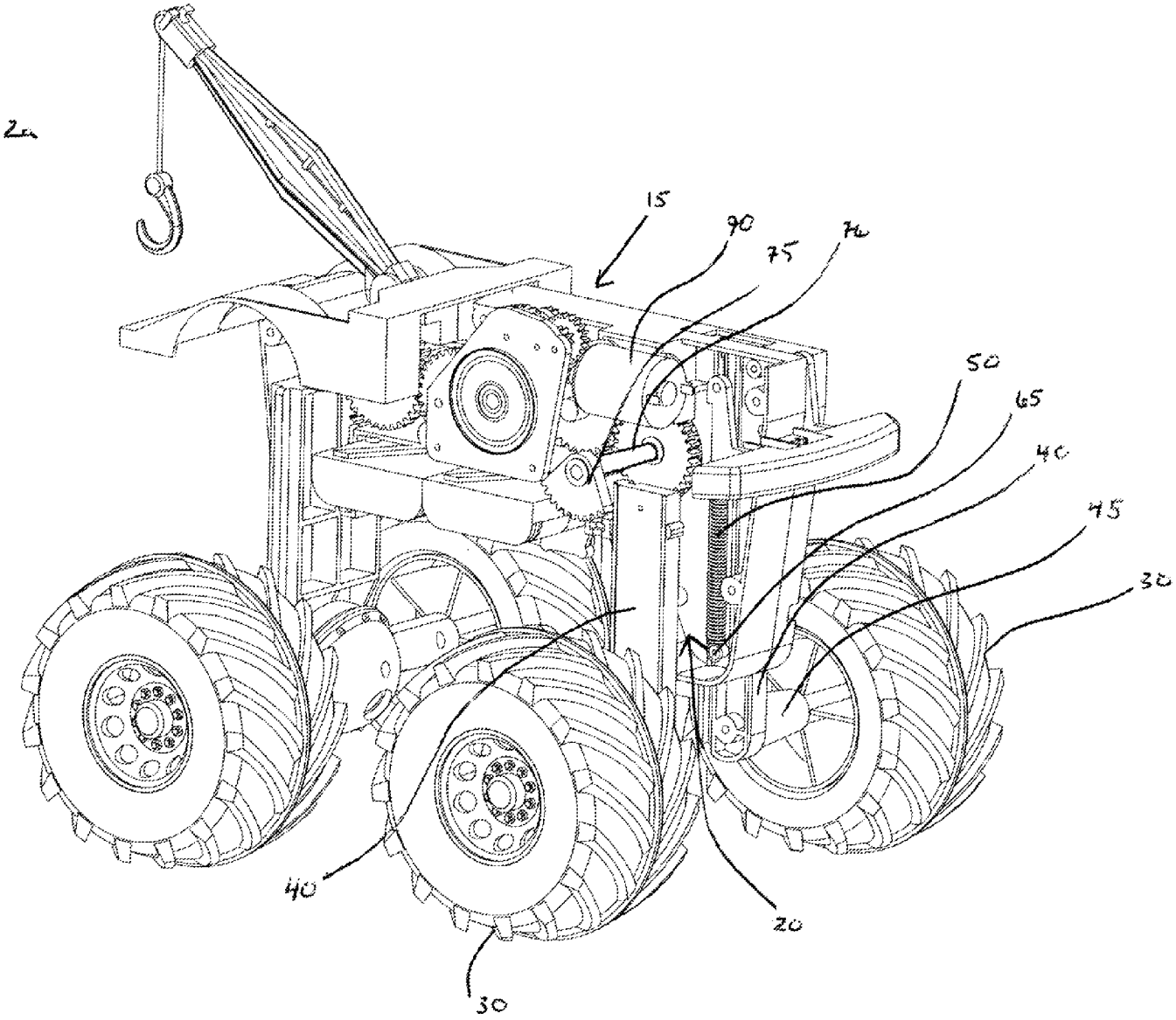
FIG. 2*a* is a front perspective view of the vehicle from FIG. 1 where a portion of an outer housing is removed.
FIG. 2*b* is a front perspective view of the vehicle from FIG. 1 where a portion of an outer housing is removed.
Figure 2B:
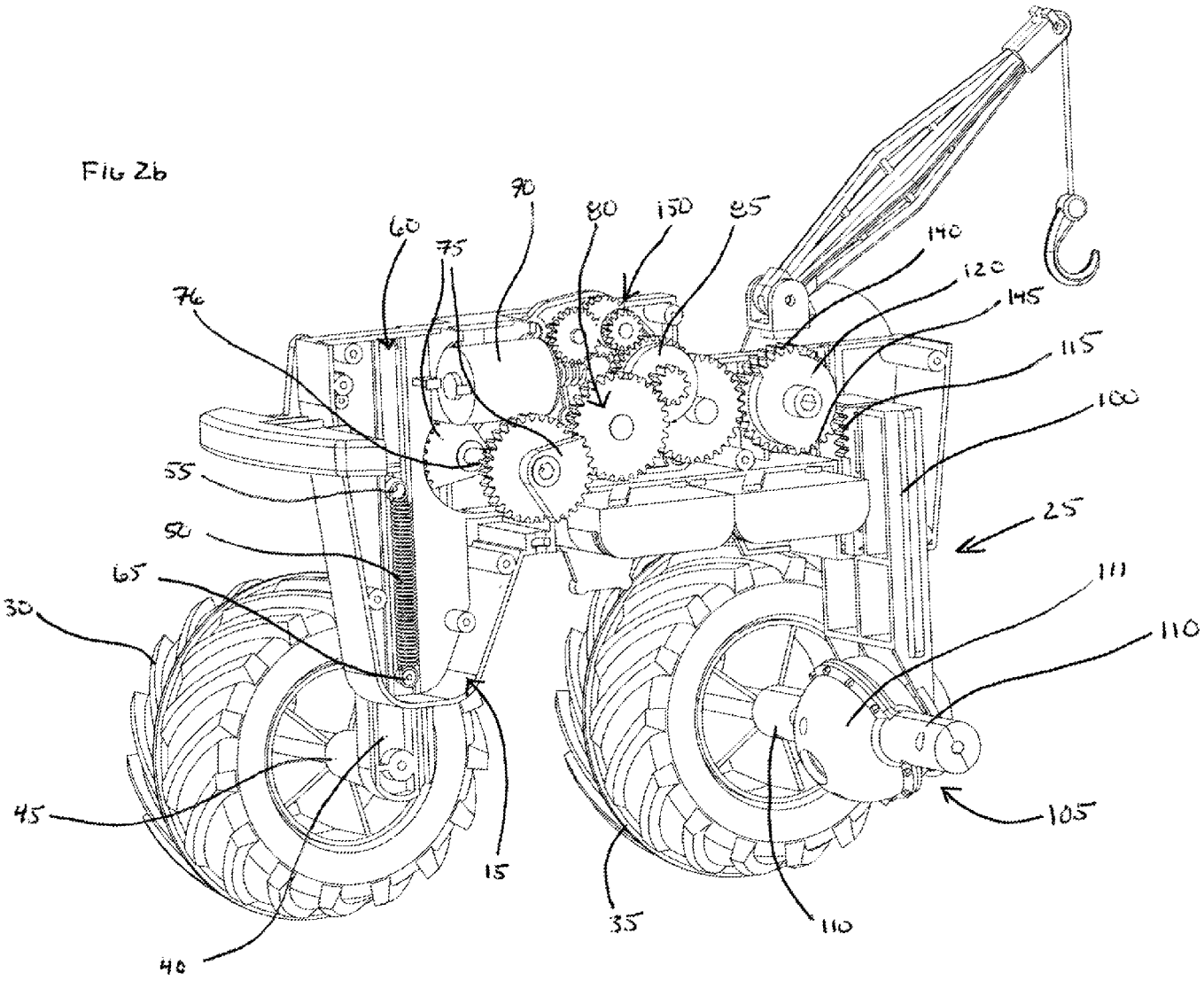

Referring now to FIGS. 1 through 2*b*, in accordance to an embodiment of the present invention, there is illustrated a vehicle 10 that includes a chassis 15, a front wheelbase mechanism 20 and a rear wheelbase mechanism 25. In this embodiment, the vehicle 10 is in the form of a toy pick up truck. However, the interactive vehicle 10 may take on several different forms, such as other types of construction vehicles, trucks, or animals. A variety of forms may be used to incorporate the internal mechanics and electronics of the interactive vehicle 10. Utilizing the internal mechanics and electronics (described below), the interactive vehicle may perform a variety of movements and actions in coordination with audio and lights. One such example of these movements is the ability of the vehicle 10 to alternatively raise and lower a set of front wheels 30 and to raise and lower a set of rear wheels 35 pivotally attached to the front wheel base mechanism 20 and the rear wheelbase mechanism 25, respectively. A plurality of switches (not shown) may be positioned throughout the vehicle to trigger preprogrammed responses of movements, sounds, and/or lights.

Figure 3A:
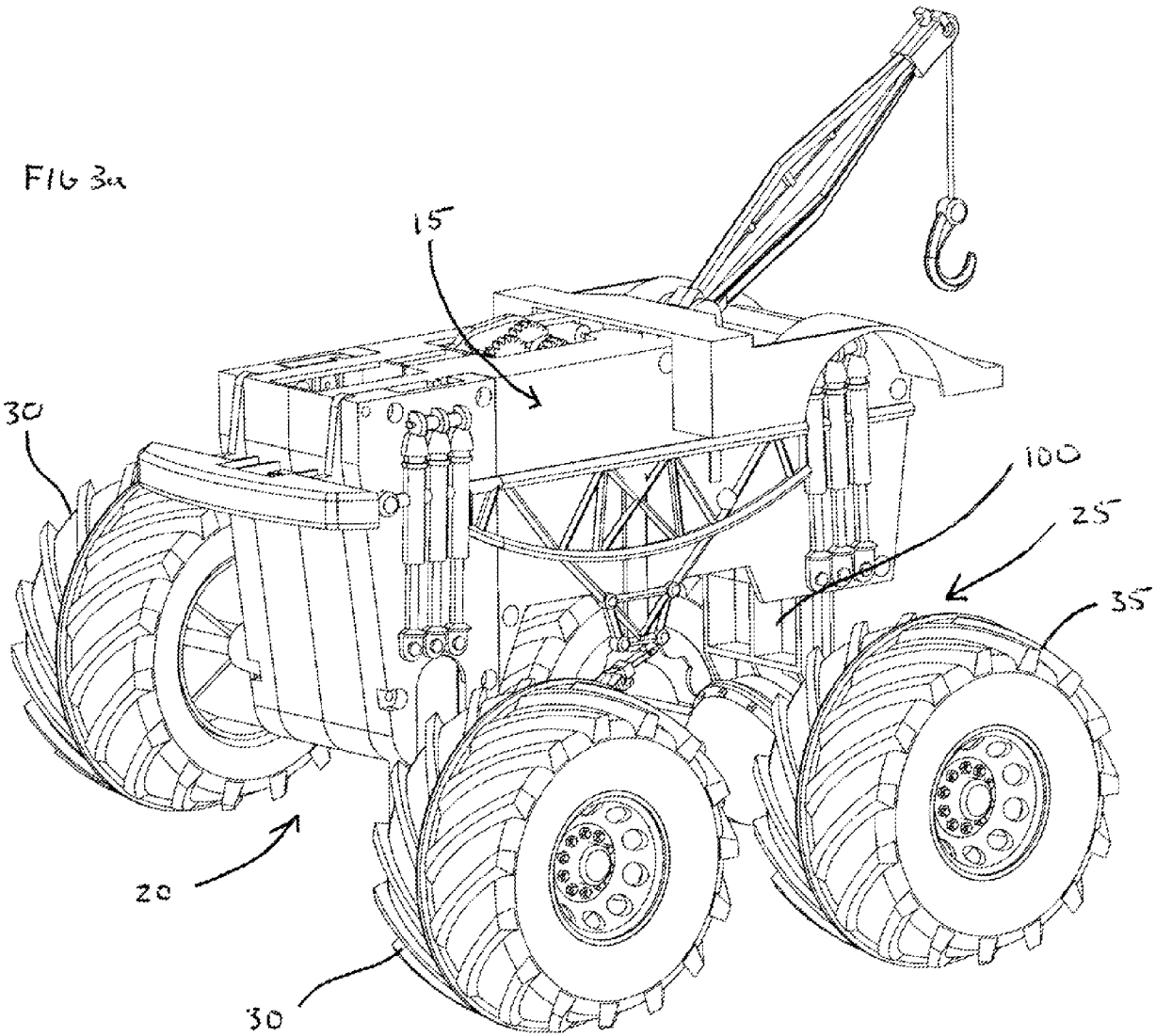
FIG. 3*a* is a perspective view of the vehicle from FIG. 1 in accordance with one embodiment of the present invention illustrating a front right wheel in a raised position.
Figure 3B:
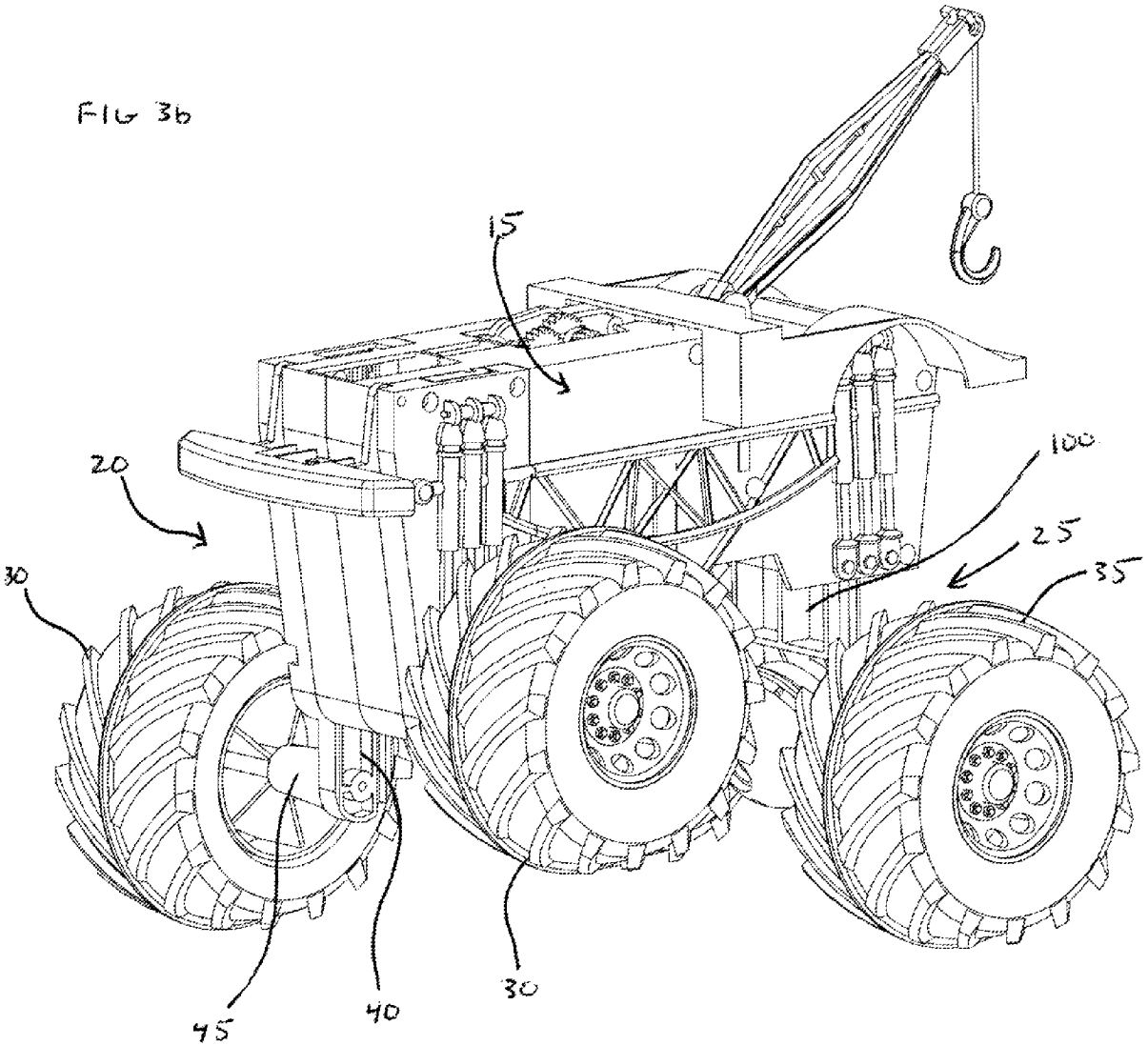
FIG. 3*b* is a perspective view of the vehicle from FIG. 1 in accordance with one embodiment of the present invention illustrating a front left wheel in a raised position.
Figure 3C:
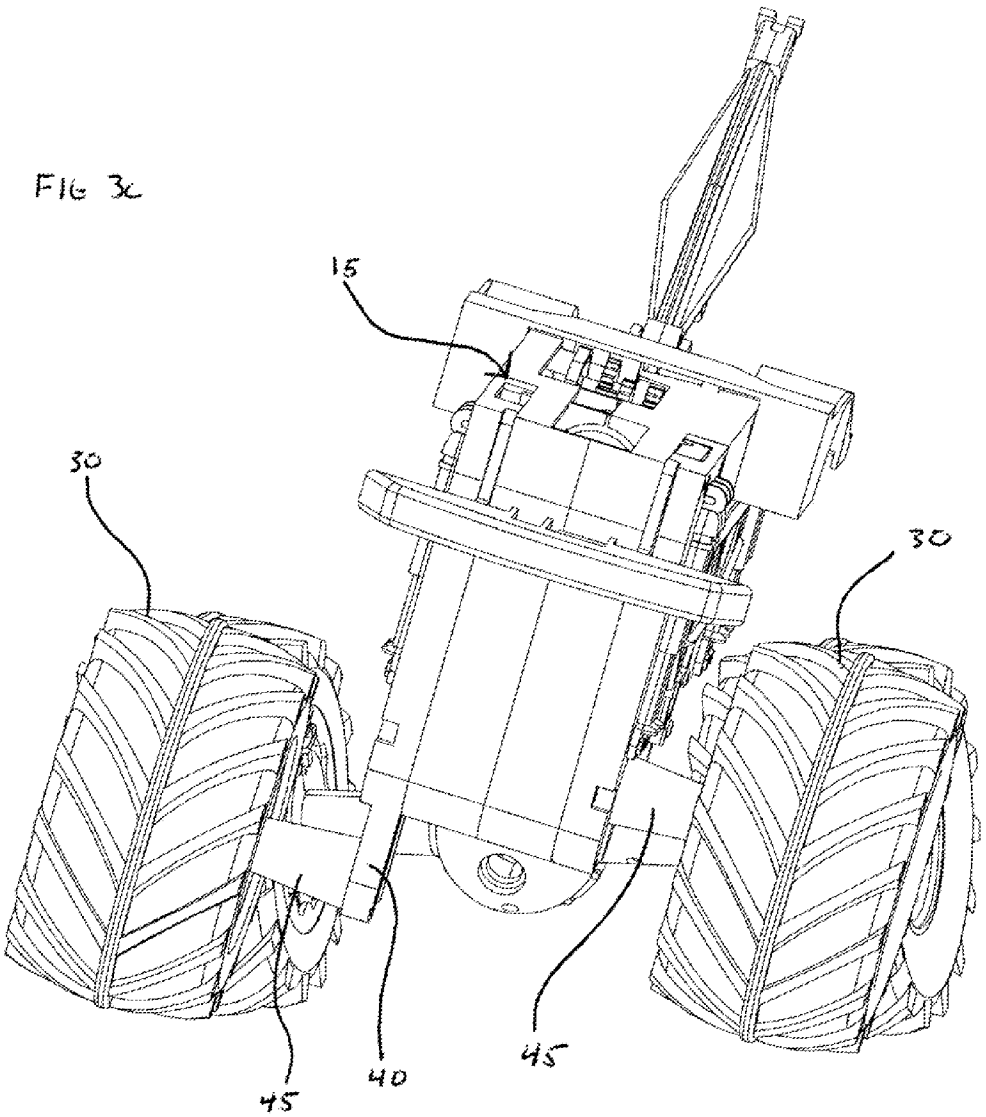
FIG. 3*c* is a front view of FIG. 3*b;*

Continuing to refer to FIGS. 1-2*b*, the front wheel base mechanism 20 is secured to the chassis 15 and includes two front segments 40, each having a wheel 30 rotatably attached to a lower end 45 of each front segment 40. A front spring 50 is secured at an upper end 55 of each front segment 40 and biased toward the wheels 30. The upper end 55 of each front segment 40 is positioned in a channel 60 to direct movement of the respective front segment 40. The other end 65 of the front spring 50 is secured to the chassis 15, such that the biased front spring 50 directs the front segment 40 to a lowered position (described below). The front segment 40 further includes a toothed edge 70 (FIG. 4*b*) that is meshed with a triangular gear 75. The triangular gear 75 is meshed to a front gear train 80 with a clutch 85 in communication with a motor 90, such that powering the motor 90 in a first direction engages the clutch 85 and directs upward and downward movement of the front segments 40. The triangular gears 75 are offset such that the upward and downward movement of the front segments 40 alternates in accordance to the powering of the motor 90. Now additionally referring to FIGS. 3*a* through 3*c*, the front wheels 30 are shown in alternating raised positions.

Figure 4A:
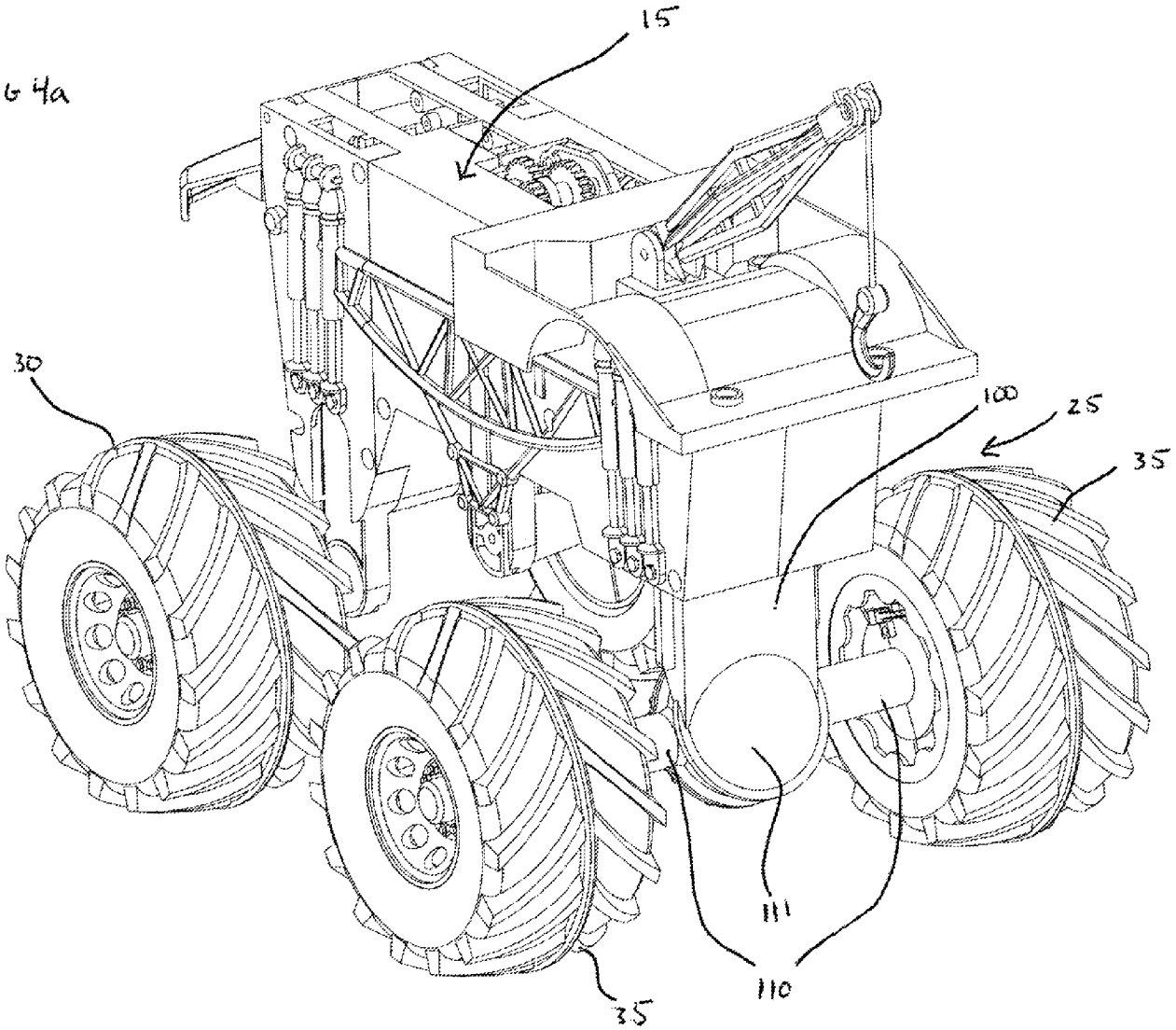
FIG. 4*a* is a rear perspective view of the vehicle from FIG. 1.
Figure 4B:
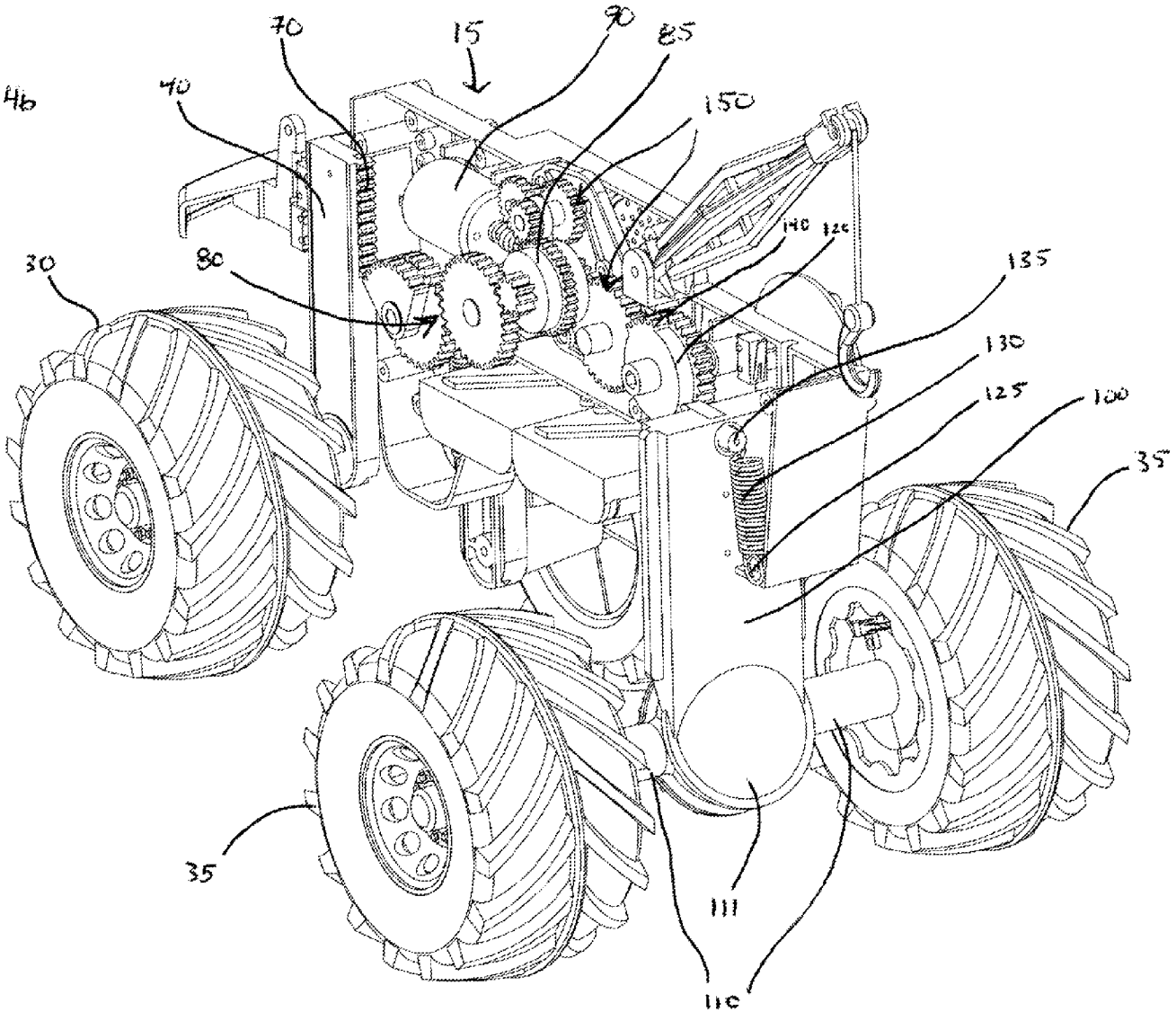
FIG. 4*b* is a rear perspective view of the vehicle from FIG. 1 with a portion of an outer housing removed.
Figure 4L:
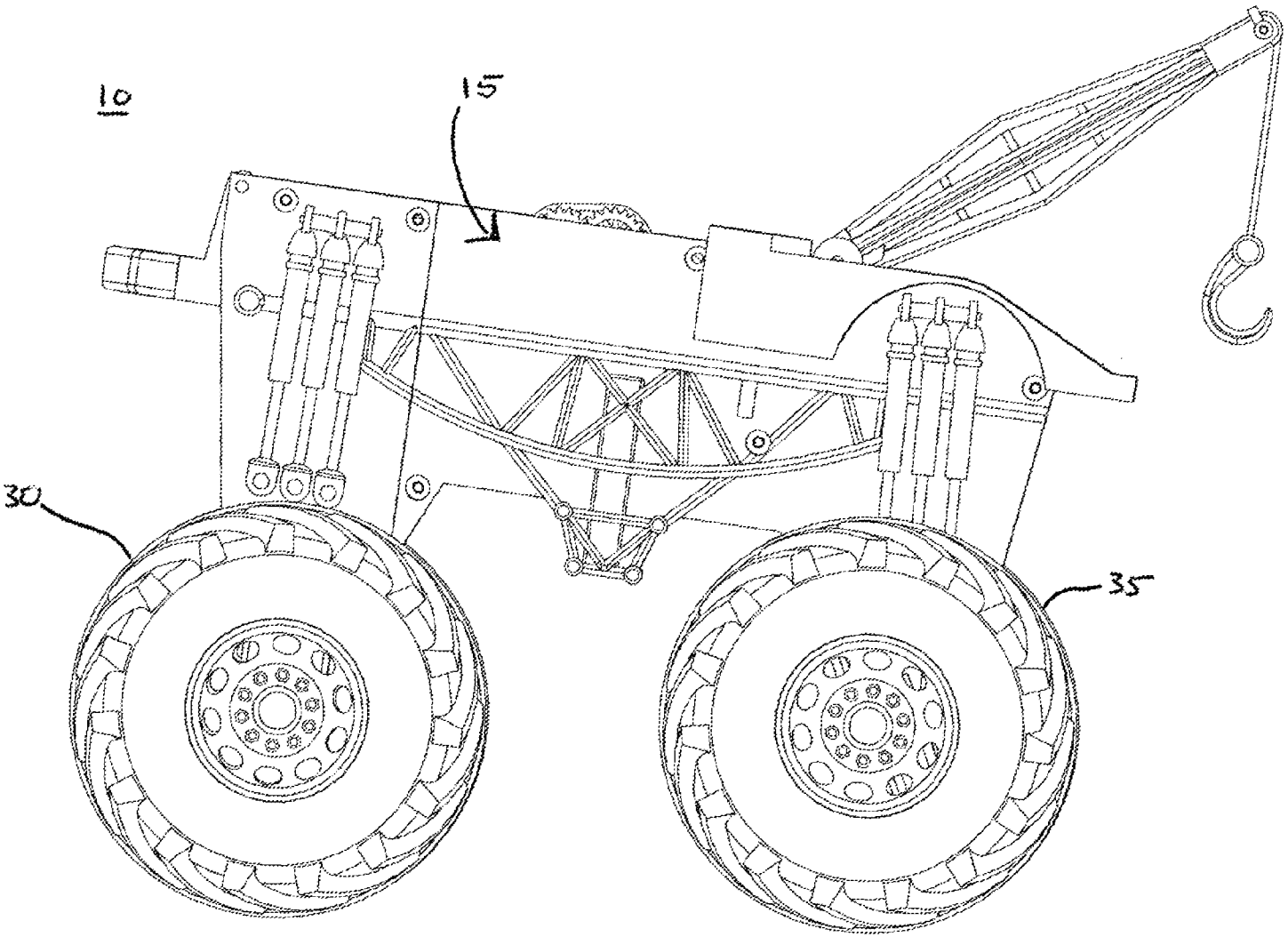
FIG. 4*c* is a side view of the vehicle from FIG. 1 where a rear wheelbase is in a raised position.

Referring again to FIG. 2*b* and additionally FIGS. 4*a* through 4*c*, the rear wheelbase mechanism 25 is moveably secured to the chassis 15 and includes a rear segment 100 with a lower portion 105 pivotally attached to a rear axle 110 including the two rear wheels 35 rotatably attached at each end of the rear axle 110. The rear segment 100 includes a rear toothed edge 115 that is meshed to a transfer gear 120. A lower portion 125 of a rear spring 130 is secured to the chassis 15 and an upper portion 135 of the rear spring 130 is secured to the rear segment 100 and downwardly biased. The transfer gear 120 is toothed at a first section 145 and a second section 150. In the embodiment illustrated, the first section 145 and second section 150 are offset, but may be positioned as desired around the circumference of the transfer gear 120. The transfer gear 120 is further meshed to a rear gear train 150 in communication with the clutch 85, such that when the motor 90 is powered in a second direction, the clutch 85 engages and transfers movement to the rear segment 100, such that the rear segment 100 moves the rear axle 110 up and down in accordance thereto. Further, the pivotal attachment of the rear axle 110 to the rear segment 100 at joint 111 provides for the pivotal movement of the rear axle 110.

The upward and downward movement of the front wheelbase mechanism 20 and the rear wheelbase mechanism 25 are controlled by an integrated circuit ("IC"). When the IC receives a signal from one of a plurality of switches (or from a remote control unit (not shown), the IC directs the motor 90 via a control signal to activate in a first direction to drive the front wheelbase mechanism 20 to alternatively raise each of the front segments 40 and the front wheels 30 rotatably attached thereto. Further, the IC may direct the motor 90 via a control signal to activate in a second direction to drive the rear wheelbase mechanism 25 to raise and lower the rear segment 100 as described above.

When one of the plurality of switches (not shown) is triggered in response to a user's input or preprogrammed content, a signal is sent via an electrical connection to the IC included in the vehicle 10. The IC contains a processor(s) and a memory 320. The processor(s) accesses preprogrammed signals or audio content stored on the memory in the IC. The IC further includes programming and electronic components to facilitate and direct audio content and control signals. The processor(s) accesses the preprogrammed signals or audio content based on a program and/or in accordance to a user's input. The processor(s) then generates a response that includes signals and may be in the form of audio or control signals. The IC may be in communication with a variety of components, such as the motor 90, a set of LED drivers (not shown), or an amplifier (not shown). From the processor(s) audio signals are transferred to the amplifier while control signals are transferred to the motor 90 to power in the desired direction, based on a program and/or in accordance to a preprogrammed response. Additionally, signals may be transferred to the LED drivers to illuminate a set of LEDs positioned throughout the vehicle 10. As a user triggers one or more of the plurality of switches, the vehicle 10 in response thereto may execute a performance pattern through movement and audio. Audio is played through a speaker when the IC sends audio content to the amplifier. A power source (not shown) is included in the vehicle 10 to supply power where necessary. It should further be contemplated that the vehicle 10 could include the capability for RC or IR control.

In the first embodiment, the vehicle 10 includes a means to independently raise and lower each of the front wheels 30.

Further and in accordance with the first embodiment, the vehicle 10 includes a means to raise and lower the rear wheels 35.

The first embodiment of the vehicle 10 also includes a means to execute a punching movement with the front wheels 30 when the vehicle 10 is positioned such that the front end of the vehicle is in a substantially upright position.

Additionally, the vehicle 10 includes a means to trigger preprogrammed movements of the components of the vehicle 10 while simultaneously outputting audio.

It is also important to note that the embodiments disclosed herein cover the vehicle 10 that utilizes preprogrammed content or direct user input to direct and trigger responses. It should be further noted that responses can be directed and triggered in a radio controlled embodiment utilizing a transmitter/receiver for communication from a user to the IC.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or inferred.

We claim:

1. A toy vehicle comprising:

a chassis;

a front wheelbase mechanism moveably secured to the chassis to raise and lower a set of front wheels;

the front wheelbase mechanism further including:

two front segments, each having one of the front wheels rotatably attached to a lower end of each segment, the front segments further positioned within two channels in the chassis, the channel guiding movement of the front segments;

two front springs secured at an upper end of each front segment and to the chassis, the springs further being biased toward the lower end of each segment;

each front segment further including a toothed edge meshed to a front gear train in communication with a motor and including a clutch, such that when the motor is powered in a first direction, the clutch engages the front gear train to direct upward and downward movement of the front segments;

the front gear train further including two triangular gears meshed to the toothed portion of the front segments, the triangular gears having less than 360 degrees of teeth, wherein the triangular gears direct the front segments downward while the teeth are meshed, then the front springs pull the front segment upward when the teeth are not meshed;

a rear wheelbase mechanism moveably secured to the chassis to raise and lower a set of rear wheels pivotally secured to the rear wheelbase mechanism; the rear wheelbase mechanism further including:

a rear segment with a lower portion pivotally attached to a rear axle including the set of rear wheels rotatably attached thereto;

the rear segment further including a rear toothed edge meshed to a transfer gear;

a lower portion of a rear spring secured to the chassis and an upper portion of the rear spring is secured to the rear segment and biased toward the rear axle; and the transfer gear further being meshed to a rear gear train in communication with the clutch, such that when the motor is powered in a second direction, the clutch engages and transfers movement to the rear segment and rear axle, such that the rear segment raises and lowers the rear axle;

an integrated circuit for receiving signals generated in response to a triggering means and for controlling activation of the motor to direct movement of the front wheels and rear wheels in response to the signals;

wherein, powering the motor in the first and second directions animates the vehicle as the front segments and rear segment raise and lower.

2. The vehicle of claim 1, wherein the toothed portions of the triangular gears are offset relative to one another such that the front segments alternately raise and lower as the motor powers in the first direction.

3. The vehicle of claim 2, the rear gear train further including:

the transfer gear having less than 360 degrees of teeth, wherein the transfer gear directs the rear segment downward while the teeth are meshed, then the rear spring pulls the rear segment upward when the teeth are not meshed.

4. The vehicle of claim 3, wherein the vehicle further includes:

a circuit board in communication with the triggering means and a receiver; and a remote control unit with a transmitter to send commands to the receiver, such that the circuit board can send control signals to the triggering means to activate and power the motor in a first and/or second direction.

* * * * *